US005457900A

United States Patent [19]

Roy

[11] Patent Number: 5,457,900

[45] Date of Patent: Oct. 17, 1995

[54] FOOTWEAR DISPLAY DEVICE

[76] Inventor: Avery J. Roy, 638 Jones St., Ingalls, Ind. 46048

[21] Appl. No.: 220,830

[22] Filed: Mar. 31, 1994

[51] Int. Cl.[6] ..... A43B 23/00

[52] U.S. Cl. ..... 36/137; 36/136; 362/103; 362/802; 315/323

[58] Field of Search ..... 36/137, 136, 139; 362/103, 802, 267; 315/323, 241 S

[56] References Cited

U.S. PATENT DOCUMENTS 4,298,917 11/1981 Ware ..... 362/103 X
4,308,572 12/1981 Davidson ..... 362/103
4,848,009 7/1989 Rodgers ..... 36/137
5,033,212 7/1991 Evanyk ..... 36/137
5,188,447 2/1993 Chiang et al. ..... 362/103

*Primary Examiner*—Paul T. Sewell
*Assistant Examiner*—Ted Kavanaugh
*Attorney, Agent, or Firm*—Reising, Ethington, Barnard, Perry & Milton

[57] ABSTRACT

A piece of footwear (12) includes a stroboscopic display device (10). The display device (10) includes a plurality of light emitting diodes (LEDs) (14) along a single array. The plurality of LEDs 14 are strobed or switched on and off through a set non-random fashion such that the plurality of LEDs (14) display a two-dimensional graphic image when the footwear (12) is moved through a step. A control (16) calculates the velocity of the step to determine the rate at which the LEDs (14) are to be strobed.

18 Claims, 4 Drawing Sheets

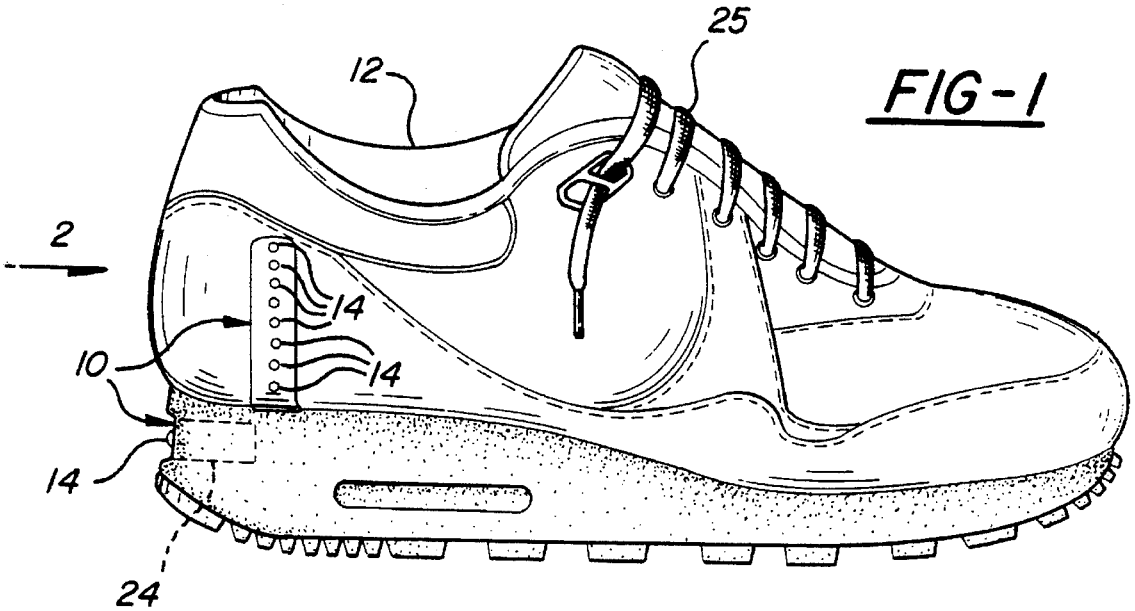
FIG-1
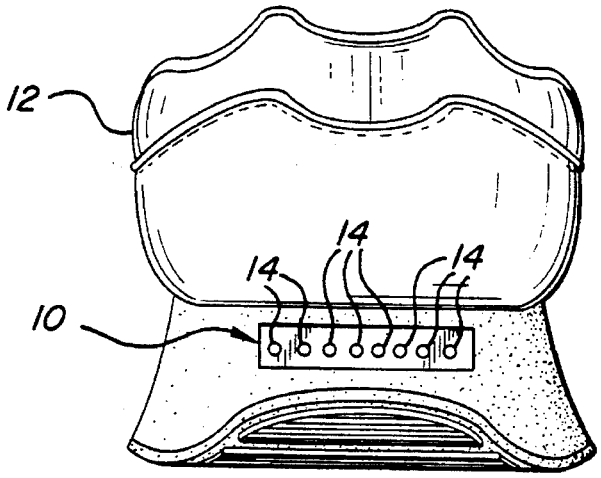
FIG-2
FIG-3
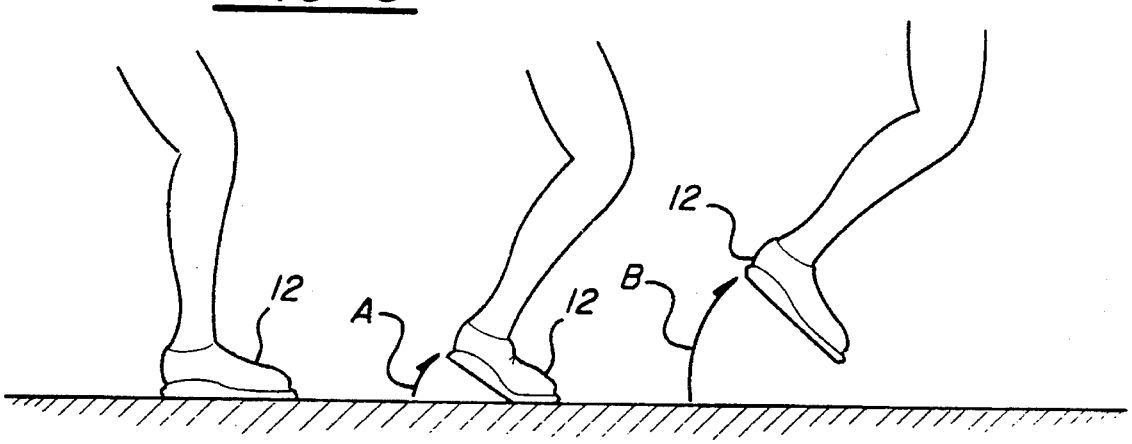

FOOTWEAR DISPLAY DEVICE

BACKGROUND OF THE INVENTION

1. Field of the Invention

The invention relates to footwear display devices. More specifically, the invention relates to footwear display devices capable display an intelligible message.

2. Description of Related Art

Athletic shoes have become a status symbol among children and young adults. The athletic shoe industry is constantly attempting to bring new products to the marketplace. A new development in the athletic shoe technology is the electronic display apparatuses. As people walk, run and jump, one or more lights emit light.

U.S. Pat. No. 4,848,009, issued to Rodgers on Jul. 18, 1989, discloses flashing footwear wherein a shoe is equipped with a cell, a mercury switch, a set of light emitting diodes (LEDs), and electrical connections therebetween. When the shoe is moved out of the horizontal position, the mercury switch closes the circuit and the LEDs flash pursuant to a timing circuit. This system does not, however, disclose a means for using the lights to display an intelligible or graphic message using alphanumeric as well as other symbols.

SUMMARY OF THE INVENTION

A light emitting display device is adaptable to be mounted to footwear. The light emitting display device comprises a plurality of lighting units which are switchable between a light emitting state and a dormant state. The light emitting display device is characterized by control for calculating velocity of the footwear as it moves through a stepping motion. The control also strobes each of said plurality of lighting units independently thereof at a rate based on the velocity of the footwear such that the plurality of lighting units display an intelligible message.

The invention is a device which provides an electronic, graphic message in the small space of a piece of footwear by incorporating the movement of the footwear to effectively increase the display surface area of the invention without physically increasing the size of the display surface area.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a side view of a piece of footwear including the preferred embodiment of the subject invention;

FIG. 2 is an view taken along lines 2—2 of FIG. 1;

FIG. 3 is a graphic representation of the positioning of a piece of footwear when a person is walking;

DETAILED DESCRIPTION OF THE PREFERRED EMBODIMENT

Figure 4A:
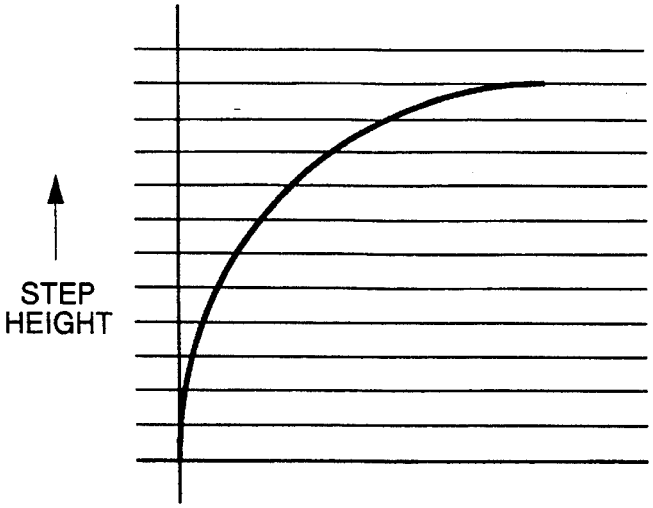
FIG. 4A is a graphic representation of graphic representation of step height.

Turning to the Figures, wherein like primed numerals represent similar parts of different embodiments, a light emitting display device is generally indicated at 10 in the Figures. The light emitting display device 10 is adapted to be mounted to footwear 12. The light emitting display device 10 includes a plurality of lighting units 14 which are switchable between a light emitting state 15 and a dormant state 17, best seen in FIGS. 4A and 4B.

The light emitting display device 10 is characterized by a control 16 calculating the velocity of the footwear 12 as it moves through a stepping motion. Velocity is a vector quantity which represents the direction of movement and the scalar quantity of speed, i.e., how fast the footwear 12 is moving. For purposes of this disclosure, it is assumed that the footwear is moving in a linear motion rendering the vector defining the velocity a constant.

The control 16 then strobes each of the plurality of lighting units 14 individually and independently thereof based on the velocity measurement made by the control 16. In addition, the control 16 controls each of the plurality of lighting units 14 such that the plurality of lighting units 14 display a graphic message based on the rate of the velocity of the footwear 12. The graphic message may include any type of symbol, i.e., alphanumeric symbols, logos, geometric figures, and the like. The list of graphic symbols is not meant to be exhaustive as any graphic symbol capable of being perceived or comprehended would be appropriate to be displayed. Said another way, any intelligible can be displayed via the plurality of lighting units 14.

The plurality of lighting units 14 includes a one dimensional array of lighting units 14 oriented either horizontally on the back of the footwear 12 or vertically on the side of the footwear 12 (both orientations shown in FIG. 1). The lighting units, LEDs in the preferred embodiment, are strobed on and off in a non-random sequence such that when the footwear 12 moves through the arcuate path A,B of a step (see FIG. 3), the strobed lights display a graphic message. The stroboscopic message appears to be two dimensional when, in fact, the source, i.e., the LEDs 14 are a single array of lighting units. Obviously, if the shoe design permits, more than a single one dimensional array may be used. However, the one dimensional array of the LEDs 14 minimizes the surface area for a two dimensional output the size of the step A,B.

Figure 4B:
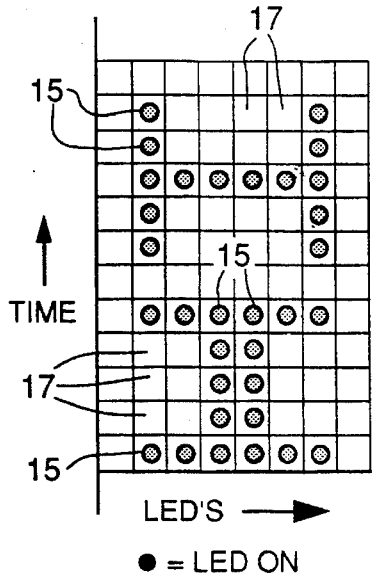
FIG. 4B is a graphic representation of as a function of time.

Turning to FIG. 4A, a graphic representation of the motion of the back of the footwear 12 is shown wherein the step height is shown as a function of time. It can be seen that the upward motion of the footwear 12 can be represented by a substantially linear movement while the plurality of LEDs 14 are visible to a viewer from behind. In FIG. 4B, a possible graphic display is shown wherein the single one-dimensional array of LEDs 14 is shown twelve times as it moves upwardly through time. The LEDs 14 are strobed or switched on and off to display the alphanumeric representation of "HI."

The control 16 further includes strobing circuit 18 for strobing each of the plurality of lighting units 14 independently of each other. The strobing circuit 18 consists of several independent switches operated by the control 16.

In an alternative embodiment, the control 16 calculates the average time the footwear 12 moves through a step, as opposed to calculating the velocity of the footwear 12. This method of determining a time period through which the lighting units 14 move is sufficient for non-alphanumeric graphic images.

Figure 7:
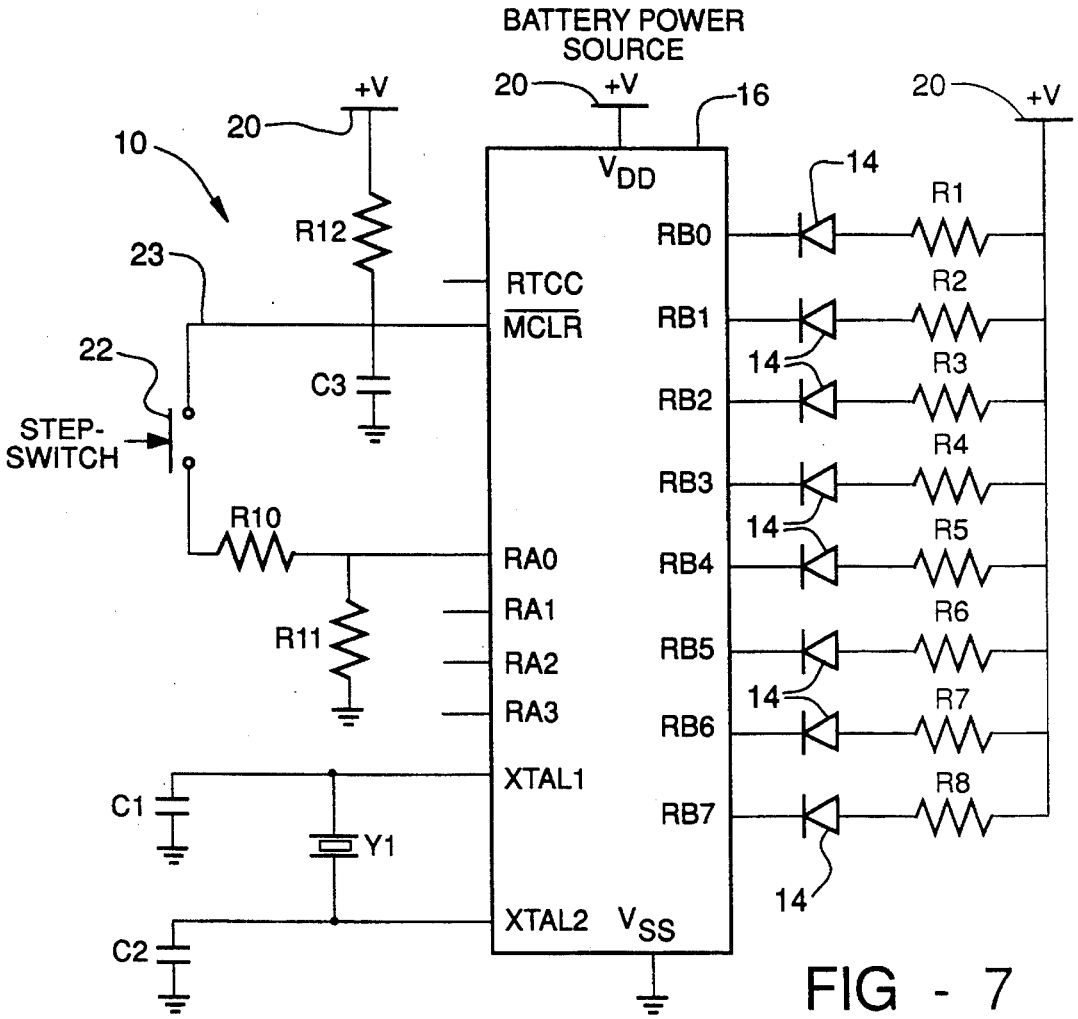
FIG. 7 is a schematic diagram of a circuit of the preferred embodiment of the subject invention.
Figure 5:
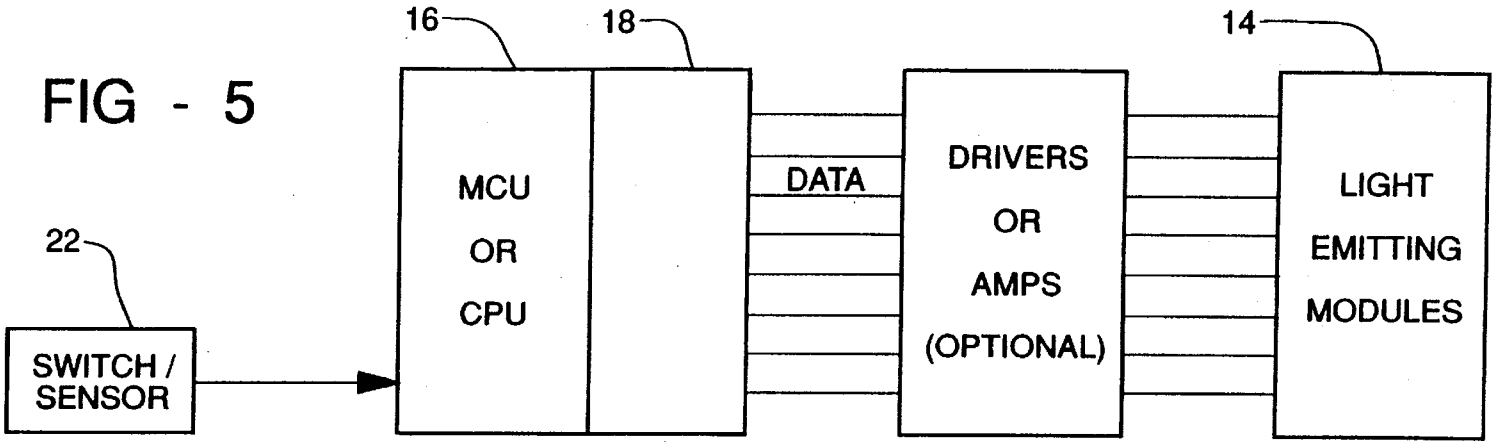
FIG. 5 is a block diagram of one embodiment of the subject invention.
Figure 6:
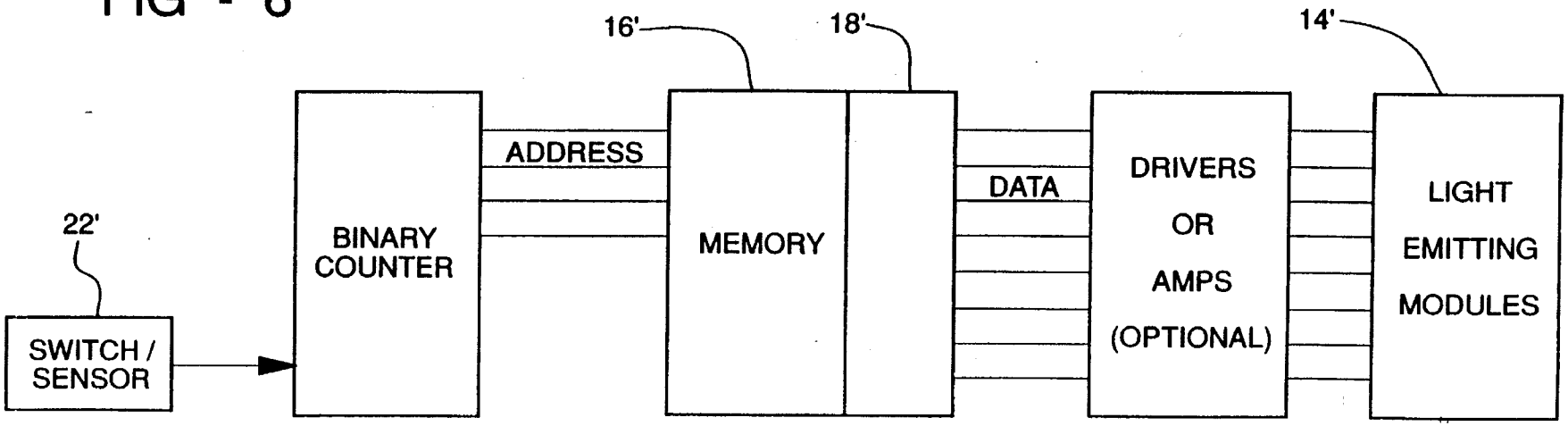
FIG. 6 is a block diagram of a second embodiment of the subject invention.

A cell 20, schematically represented in FIG. 7, stores energy to be used by the control 16 and the LEDs 14. The cell 20 is electrically connected to the control 14 and the plurality of LEDs 14. The cell 20 may be replaced by a battery which is dependent, of course, on the output requirements of the LEDs 14.

A motion switch or sensor 22 determines when the footwear 12 is being moved through a step. The motion switch 22 closes a loop 23 of the circuit, the closing of which is detected by the control 16.

A housing 24 houses the control 16 and the cell 20 therein. The housing 24 further mounts the LEDs 14 thereto. Said another way, the housing 24 creates unitary package for the invention 10 to be easily inserted in the footwear 12. An alternative embodiment may include a housing 24 which is detached from the LEDs 14 so it may be stored or fixed to the footwear 12 remotely therefrom, i.e., near or about the laces 25. The housing 24 may be secured to the footwear 12 via epoxy, a hoop and hook material combination such as Velcro®. Any fastener known in the art will be acceptable to secure the housing 24 to the footwear 12.

Turning to FIG. 7, the LEDs 14 are connected to the cell 20 through resistors R1–R8. The LEDs 14 are also connected to the control 16 at ports RB0–RB7. One end of the step-switch 22 is connected to capacitor C3, resistor R12, and port MCLR. The capacitor C3 is connected to ground. The other end of the step-switch 22 is connected to resistors R10, R11 and port RA0. The resistor R11 is also connected to ground. An oscillator Y1 is tied between two capacitors C1,C2 and two ports XTAL1,XTAL2 of the control 16. The capacitors C1,C2 are also connected to ground.

Figure 8:
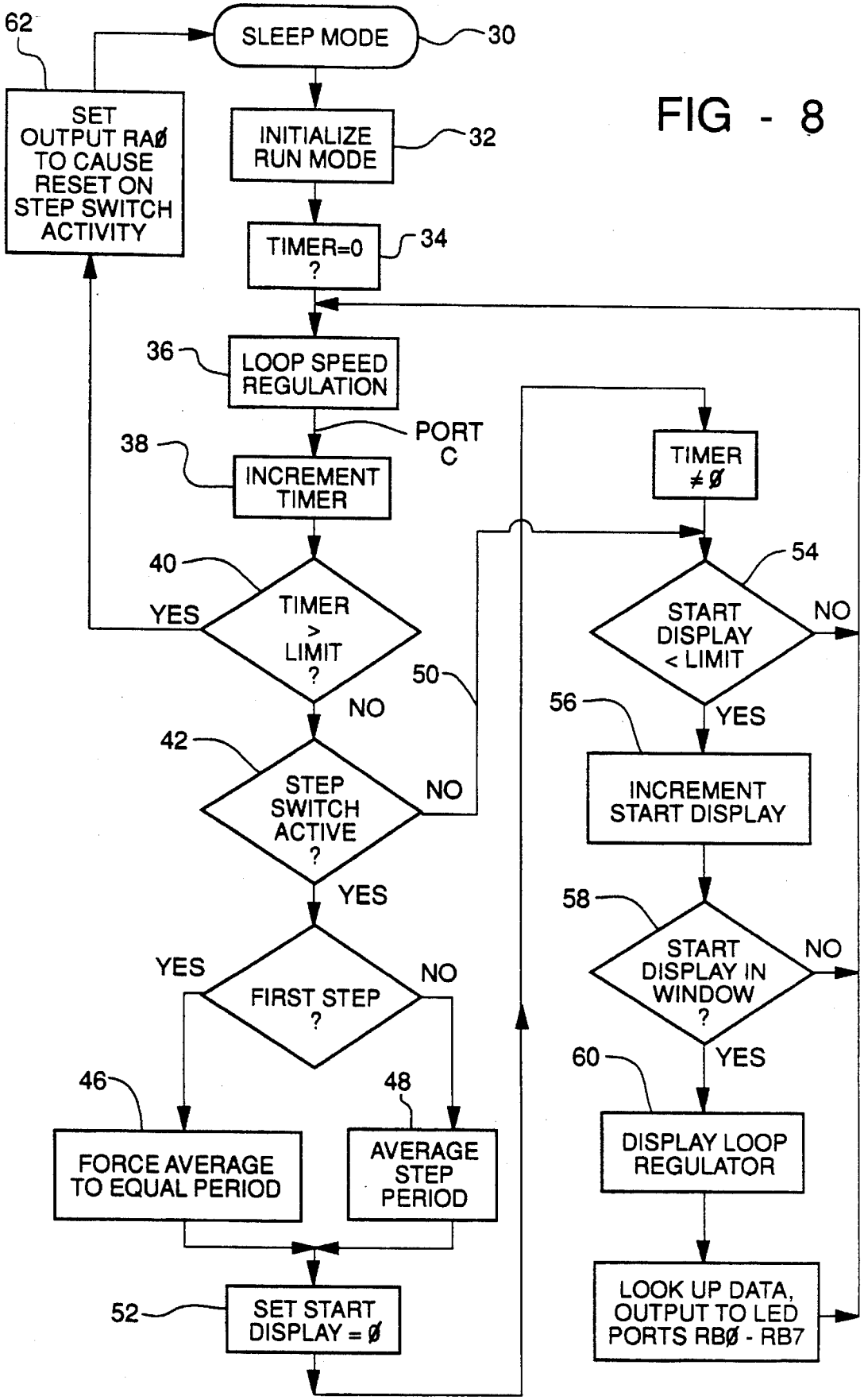
FIG. 8 is a flow chart representing the steps of the controller of the preferred embodiment of the subject invention.

Turning to FIG. 8, a flow chart represents the steps through which the control 16 operates. The sleep mode 30 represents the footwear 12 at rest. No action occurs until the footwear 12 moves because the graphic display will not be intelligible when the footwear 12 is not moving. In addition, the sleep mode 30 acts as a power saver to prevent the LEDs 14 from operating when the footwear 12 is not moving.

The control 16 is initialized at 32. Initialization includes establishing values for the variables and parameters for the run mode. This step also includes setting the I/O port, RA0 pin, to input mode so that a step will not cause the control 16 to reset. The control 16, with the RA0 pin at input mode will cause display data to be sent to the LEDs. The interval timer 34 is set to zero at this point.

Upon entering the "RUN MODE," the loop speed is the regulated, 36. The typical loop speed regulation at point C is one thousand Hertz (1,000 Hz). The timer is incremented, 38, by one (1). By way of example, if the loop speed regulation is at 1,000 Hz, the timer will increment at 1,000 counts per second. The timer limit is checked, 40, and, if the timer exceeds a predetermined value, then the control 16 enters the sleep mode 30 as the pin RA0 is set to output a low value, 62. The typical count for the limit is 4,000. Or, in other words, the sleep mode 30 is entered after approximately four seconds.

If the limit has not been reached, the step switch 22 is checked to determine if it is active, 42. If the step switch 22 is active, the average step period will be determined to equal the period of the first step, 46. If the step taken is not the first step, an average of the previous four steps is taken to determine the average stepping period, 48.

Once the step is taken or, as is indicated by "NO" line 50, if the step switch 22 is not active, a "START DISPLAY" variable is set to zero, 52. The "START DISPLAY" mode will trigger the display routine to execute on near future runs. If the "START DISPLAY" variable is less than a predetermined value, the display routines are then executed, 54. Otherwise, the routine is sent back to point D.

After the "START DISPLAY" is incremented, 56, a test determines whether the display counter is within the targeted display area, 58. If so, the display loop regulator then, at 60, adjusts the speed at which the display is being sent to the LEDs 14. If not, the program returns to point D allowing the loop speed to be regulated. Finally, the data is retrieved from the control 16 or memory 16' and it is sent to the LEDs to be displayed.

The program then returns to point D and runs through the sequence again.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

I claim:

1. A light emitting display device (10) adaptable to be mounted to footwear (12), said light emitting display device comprising:

a plurality of lighting units (14) switchable between a light emitting state and a dormant state, said light emitting display device (10) characterized by a control (16) for calculating velocity of the footwear (12) as it moves through a stepping motion and for strobing each of said plurality of lighting units (14) independently thereof and at a rate based on said velocity such that said plurality of lighting units (14) display a graphic message.

2. A device (10) as set forth in claim 1 further characterized by said plurality of lighting units (14) including a one dimensional array of lighting units.

3. A device (10) as set forth in claim 2 further characterized by said control (16) including a strobing circuit (18) for strobing each of said plurality of lighting units (14) independently of each other.

4. A device (10) as set forth in claim 3 further characterized by a cell (20) for storing energy, said cell (20) electrically connected to said control (16) and said plurality of lighting units (14).

5. A device (10) as set forth in claim 4 further characterized by a motion switch (22) for disconnecting said cell (20) from said control when the velocity of the footwear (12) is zero.

6. A device (10) as set forth in claim 5 further characterized by a housing (24) for housing said control (16) and said cell (20) therein and for mounting said plurality of lighting units (14) thereto.

7. A device (10) as set forth in claim 6 further characterized by each of said plurality of lighting units (14) being a light emitting diode.

8. A device (10) as set forth in claim 7 further characterized by said graphic message including alphanumeric symbols.

9. A light emitting display device (10) adaptable to be mounted to footwear (12), said light emitting display device (10) comprising:

a piece of footwear (12);

a housing (24) fixedly secured to said footwear (12);

a plurality of lighting units (14) fixedly secured to said housing (24) switchable between a light emitting state and a dormant state, said light emitting display device (10) characterized by a control circuit (16) for calculating velocity of the footwear (12) as it moves through a stepping motion and for strobing each of said plurality of lighting units (14) independently thereof and at a rate based on said velocity such that said plurality of lighting units (14) display a graphic message.

10. A light emitting display device (10) adaptable to be mounted to footwear (12), said light emitting display device comprising:

a plurality of lighting units (14) switchable between a light emitting state and a dormant state, said light emitting display device (10) characterized by a control (16) for calculating the average time the footwear (12) moves through a stepping motion and for strobing each of said plurality of lighting units (14) independently thereof and at a rate based on said average time such that said plurality of lighting units (14) display a graphic message.

11. A device (10) as set forth in claim 10 further characterized by said plurality of lighting units (14) including a one dimensional array of lighting units.

12. A device (10) as set forth in claim 11 further characterized by said control (16) including a strobing circuit (18) for strobing each of said plurality of lighting units (14) independently of each other.

13. A device (10) as set forth in claim 12 further characterized by a cell (20) for storing energy, said cell (20) electrically connected to said control (16) and said plurality of lighting units (14).

14. A device (10) as set forth in claim 13 further characterized by a motion switch (22) for disconnecting said cell (20) from said control when the average time of the stepping motion of the footwear (12) is zero.

15. A device (10) as set forth in claim 14 further characterized by a housing (24) for housing said control (16) and said cell (20) therein and for mounting said plurality of lighting units (14) thereto.

16. A device (10) as set forth in claim 15 further characterized by each of said plurality of lighting units (14) being a light emitting diode.

17. A device (10) as set forth in claim 16 further characterized by said graphic message including alphanumeric symbols.

18. A method for displaying a graphic two dimensional display on a piece of footwear (12) using a plurality of lights (14) arranged in a single dimension, the method including the steps of:

moving each of the plurality of lights (14) through a light emitting state and a dormant state;

moving the piece of footwear (12) through a step to create a two dimensional graphic display; and calculating the average time the plurality of lights (14) move through a step so that the plurality of lights (14) switch between the emitting state and the dormant state in a period dependent on the average time of the step of the footwear (12).

* * * * *